US011839277B1

(12) United States Patent
Peng

(10) Patent No.: US 11,839,277 B1
(45) Date of Patent: Dec. 12, 2023

(54) CARD STORAGE DEVICE

(71) Applicant: Qiyong Peng, Yichun (CN)

(72) Inventor: Qiyong Peng, Yichun (CN)

( * ) Notice: Subject to any disclaimer, the term of this patent is extended or adjusted under 35 U.S.C. 154(b) by 0 days.

(21) Appl. No.: 18/320,568

(22) Filed: May 19, 2023

(51) Int. Cl.
*A45C 11/18* (2006.01)

(52) U.S. Cl.
CPC ..... *A45C 11/182* (2013.01)

(58) Field of Classification Search
CPC ..... A45C 11/182
See application file for complete search history.

(56) References Cited

U.S. PATENT DOCUMENTS

2018/0310681 A1* 11/2018 Wingerter ..... B42F 17/32
2018/0338593 A1* 11/2018 Scharnigg ..... B65D 83/08
2021/0032009 A1* 2/2021 Minson ..... A45C 11/182
2022/0079316 A1* 3/2022 Goodwin ..... A45C 13/185

* cited by examiner

*Primary Examiner* — Sue A Weaver
(74) *Attorney, Agent, or Firm* — Daniel M. Cohn; Howard M. Cohn

(57) ABSTRACT

A card storage device includes a housing defining an accommodating cavity, a sliding piece slidably connected to the housing, and a card pushing piece arranged in the housing. The accommodating cavity penetrates the housing. The card pushing piece is connected to the sliding piece. The card pushing piece and the accommodating cavity are enclosed to form an accommodating groove. Step portions are arranged on at least one side of the card pushing piece. The step portions are arranged in steps. When the sliding piece moves toward an opening of the accommodating groove. The sliding piece drives the card pushing piece to move toward the opening of the accommodating groove. When the card pushing piece moves in a direction away from the opening of the accommodating groove, the card pushing piece drives the sliding piece to move in the direction away from the opening of the accommodating groove.

20 Claims, 9 Drawing Sheets

CARD STORAGE DEVICE

TECHNICAL FIELD

The present disclosure relates to a technical field of storage devices, and in particular to a card storage device.

BACKGROUND

In modern life, people have to deal with cards more or less. With development of an economic level, there are more and more types of cards. For example, when shopping in a supermarket, a person needs to use a membership card and a credit card; when taking a bus, the person needs to use a bus card or a subway card; when going to the hospital, the person needs a social security card, an ID card, etc. Various types of cards undoubtedly provide a lot of convenience for people's life. In order to better classify and store the cards, a wide variety of card storage devices appears on the market.

In the era when cash payments were popular, wallets were the most common card storage device. However, with popularization of electronic payment, people are more willing to travel lightly, and a wallet is generally too large and inconvenient to carry. Carrying the wallet just to store the cards is not worth the candle. Therefore, there are more and more card storage devices specially configured to store the cards on the market. These card storage devices are small in size and light in weight, and are favored by customers.

However, these card storage devices still have disadvantages. That is, when a specific card needs to be used, people still need to manually rummage the card and pull the specific card out from the card storage device, which is inconvenient to use.

SUMMARY

In order to solve problems in the prior art, the present disclosure provides a card storage device that is convenient to store and take out cards.

The present disclosure provides the card storage device configured to store and take out cards. The card storage device comprises a housing defining an accommodating cavity, a sliding piece slidably connected to the housing, and a card pushing piece arranged in the housing.

The accommodating cavity penetrates the housing. The card pushing piece is connected to the sliding piece. The card pushing piece and the accommodating cavity are enclosed to form an accommodating groove. Step portions are arranged on at least one side of the card pushing piece. The step portions are arranged in steps.

When the sliding piece moves toward an opening of the accommodating groove. The sliding piece drives the card pushing piece to move toward the opening of the accommodating groove. When the card pushing piece moves in a direction away from the opening of the accommodating groove, the card pushing piece drives the sliding piece to move in the direction away from the opening of the accommodating groove.

In some embodiments, a limiting notch is defined on a first side of the housing. A sliding structure is arranged on a first side of the sliding piece. The sliding structure is slidable in the limiting notch. The sliding structure abuts against a bottom wall of the card pushing piece.

In some embodiments, the card storage device further comprises a base, the base is connected to the housing and seals one end of the housing. The base is rotatably connected to the card pushing piece. The base seals an open end of the limiting notch.

When the sliding piece moves in a direction away from the base, the sliding structure pushes the card pushing piece to rotate in the direction away from the base. When the card pushing piece rotates in a direction close to the base, the card pushing piece pushes the sliding structure to move in the direction close to the base, so that the sliding piece moves in the direction close to the base.

In some embodiments, a shaft hole and a limiting hole are defined on the card pushing piece. A rotating shaft and a fixing shaft are arranged on the base. The card storage device further comprises an elastic piece. The shaft hole is defined on one end of the card pushing piece away from the step portions. The rotating shaft is inserted into the shaft hole. The card pushing piece rotates around the rotating shaft. A first end of the elastic piece is connected to the fixing shaft. A second end of the elastic piece is connected to the limiting hole.

When the sliding piece moves in the direction away from the base, the sliding structure pushes the card pushing piece to rotate in the direction away from the base and the elastic piece extends. When the elastic piece is reset, the elastic piece pulls the card pushing piece to rotate in the direction close to the base, and the card pushing piece pushes the sliding structure to move in the direction close to the base, so that the sliding piece is reset.

In some embodiments, the step portions are arranged on a first side of the card pushing piece. A height difference between any two adjacent step portions is a fixed value.

In some embodiments, the accommodating cavity comprises a first cavity wall and a second cavity wall. The first cavity wall and a second cavity wall of the accommodating cavity are arranged opposite to each other. A top wall of a step portion, closest to the shaft hole, of the step portions, is attached to the first cavity wall of the accommodating cavity. A bottom wall of a step portion, farthest away from the shaft hole, of the step portions, is attached to the second cavity wall of the accommodating cavity.

In some embodiments, the step portions are arranged on a first side and a second side of the card pushing piece. A height difference between any two adjacent step portions arranged on a same side is a fixed value.

In some embodiments, the step portions arranged on the first side of the card pushing piece are symmetrically arranged with the step portions arranged on the second side of the card pushing piece.

In some embodiments, the accommodating cavity comprises a first cavity wall and a second cavity wall. The first cavity wall and a second cavity wall of the accommodating cavity are arranged opposite to each other. A step portion, arranged on the first side of the card pushing piece and closest to the shaft hole, of the step portions, is attached to the first cavity wall of the accommodating cavity. A step portion, arranged on the second side of the card pushing piece and closest to the shaft hole, of the step portions, is attached to the second cavity wall of the accommodating cavity.

In some embodiments, the elastic piece is one of a spring, an elastic strap, and an elastic sheet.

In some embodiments, the base comprises a connecting portion and two hook portions. The two hook portions are connected to the connecting portion. The two hook portions are respectively arranged on two opposite sides of the connecting portion. The accommodating cavity comprises two first grooves. The first grooves are defined on two opposite sidewalls of the accommodating cavity. When the base is connected to the housing, the one end of the housing abuts against the connecting portion, and the two hook portions respectively hook the two first grooves.

In some embodiments, the base further comprises a limiting block. The limiting block is arranged on the connecting portion. The limiting block seals the open end of the limiting notch to limit a displacement of the sliding structure and prevent the sliding piece from sliding out of the housing.

In some embodiments, sliding grooves are defined on two ends of a first side of the housing. The sliding piece is slidable along the sliding grooves.

In some embodiments, elastic friction bars are arranged on two opposite sidewalls of the accommodating cavity.

In some embodiments, friction columns arranged in an array are arranged on each of the elastic friction bars. A limiting portion is arranged on a top portion of each of the elastic friction bars.

In some embodiments, an anti-slip pattern and an indicating arrow are defined on a second side of the sliding piece. The indicating arrow is configured to indicate a sliding direction of the sliding piece. The sliding piece is pushed through the anti-slip pattern.

In some embodiments, the card storage device further comprises a first decorative sheet. A shape of the first decorative sheet is matched with a shape of the sliding piece. The first decorative sheet is attached to the sliding piece. Through holes are defined on the first decorative sheet. Positions of the through holes are respectively corresponding to a position of the anti-slip pattern and a position of the indicating arrow. The anti-slip pattern and the indicating arrow are exposed from the through holes.

In some embodiments, a second side of the housing is recessed to form a second groove.

In some embodiments, the card storage device further comprises a second decorative sheet. The second decorative sheet is embedded in the second groove.

In some embodiments, a clipping notch is defined on the second side of the housing. A snapping hole is defined on a bottom wall of the second groove, a concave portion is defined on the accommodating groove. The snapping hole is defined on the concave portion. The card storage device further comprises a snapping clip. The snapping clip is detachably connected to the housing. The snapping clip comprises a clipping portion, an attaching portion, and a snapping portion. The attaching portion connects the clipping portion with the snapping portion. The clipping portion is clamped in the chipping notch. The attaching portion is inserted into the accommodating groove and attached to the concave portion. The attaching portion is flush with a sidewall of the accommodating groove. The snapping portion is snapped on the snapping hole. An outer sidewall of the snapping portion is flush with the bottom wall of the second groove.

In the embodiments of the present disclosure, the accommodating groove is configured to accommodate the cards. Each of the step portions loads one card. A user may store the cards in the accommodating groove. When the cards needs to be taken out, the user is able to push the sliding piece, so that the sliding piece moves towards the opening of the accommodating groove. Then the sliding piece pushes the card pushing piece to rotate towards the direction of the opening of the accommodating groove, and the step portions push the cards accommodated in the accommodating groove along with rotation of the card pushing piece. Therefore, the cards are partially pushed out of the accommodating groove. Since the step portions are arranged in steps, the cards being pushed out are also arranged in steps. Thus, the user is able to quickly distinguish the cards and quickly extract a specific card needed to be used. After the user releases the sliding piece, the card pushing piece moves in the direction away from the opening of the accommodating groove, so as to drive the sliding piece to move in the direction away from the opening of the accommodating groove to complete resetting of the sliding piece. Therefore, after the user releases the sliding piece, the sliding piece automatically reset, and the user does not need to manually push the sliding piece back to an original position, which is convenient to use.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

For a complete understanding of the present disclosure and its characteristics, the following description will be made in conjunction with the accompanying drawings, where same reference numbers in the following description indicate same structures.

In the drawings.

Figure 1:
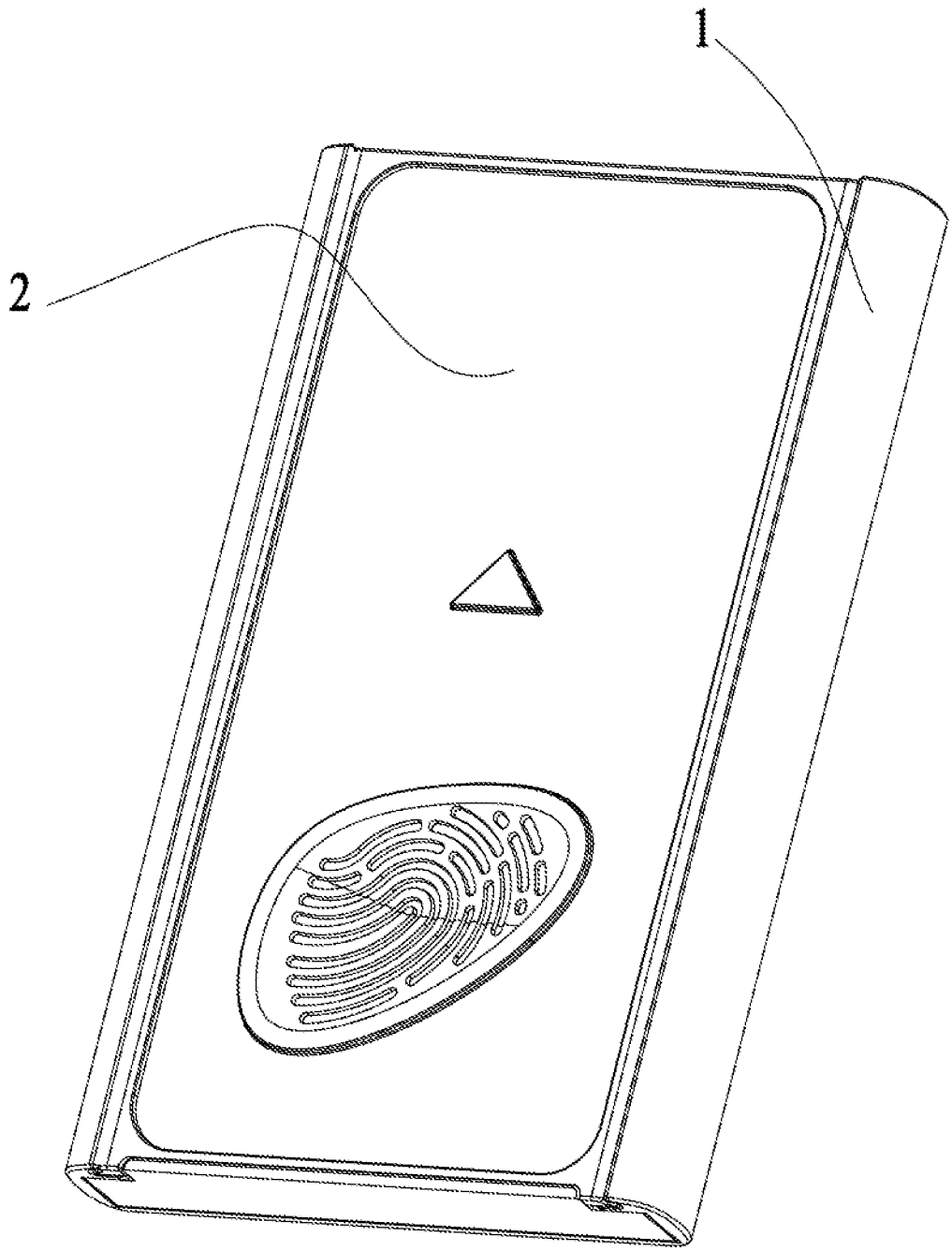
FIG. 1 is a perspective schematic diagram of a card storage device according to one embodiment of the present disclosure.
Figure 2:
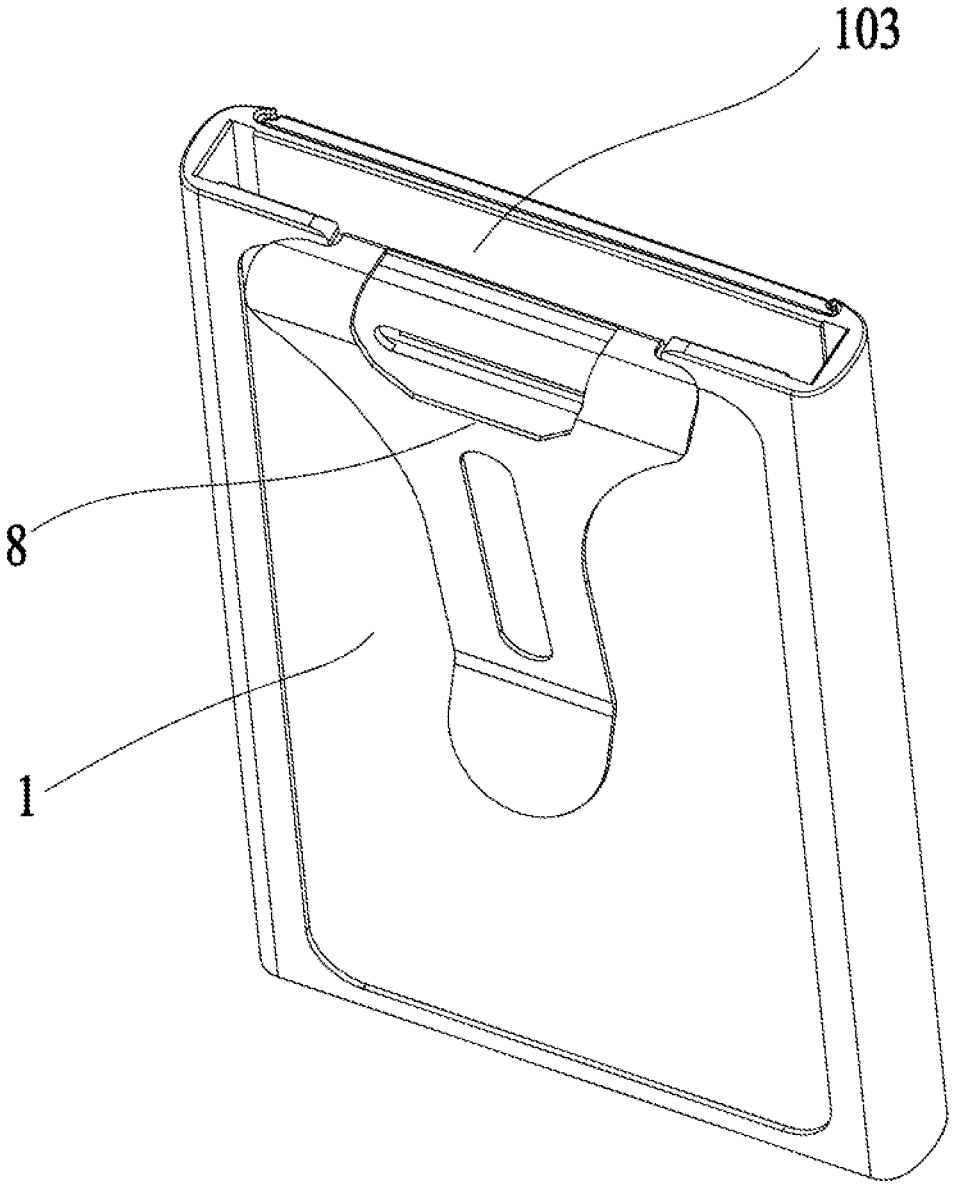
FIG. 2 is another perspective schematic diagram of the card storage device according to one embodiment of the present disclosure.

1—housing; 100—card; 101—accommodating cavity; 102—limiting notch; 103—accommodating groove; 104—sliding groove; 105—first groove; 106—opening; 107—clipping notch; 108—concave portion; 109—second groove; 2—sliding piece; 201—sliding structure; 202—anti-slip pattern; 203—indicating arrow; 3—base; 301-—connecting portion; 302—hook portion; 303—limiting block; 304—rotating shaft; 305—fixing shaft; 4—card pushing piece; 401—shaft hole; 402—limiting hole; 403—step portion; 5—elastic friction bar; 501—limiting portion; 502—friction column 6—first decorative sheet; 601—through hole; 7—second decorative sheet; 8—snapping clip; 801—clipping portion; 802—attaching portion; 803—snapping portion; 9—elastic piece.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Embodiment 1

The present disclosure provides a card storage device configured to store and take out cards 100. The card storage device comprises a housing 1 defining an accommodating cavity 101, a sliding piece 2 slidably connected to the housing 1, and a card pushing piece 4 arranged in the housing 1. The accommodating cavity 101 penetrates the housing 1. The card pushing piece 4 is connected to the sliding piece 2. The card pushing piece 4 and the accommodating cavity 101 are enclosed to form an accommodating groove 103. Step portions 403 are arranged on at least one side of the card pushing piece 4. The step portions 403 are arranged in steps.

When the sliding piece 2 moves toward an opening 106 of the accommodating groove 103. The sliding piece 2 drives the card pushing piece 4 to move toward the opening 106 of the accommodating groove 103. When the card pushing piece 4 moves in a direction away from the opening 106 of the accommodating groove 103, the card pushing piece 4 drives the sliding piece 2 to move in the direction away from the opening 106 of the accommodating groove 103.

In the embodiment, the accommodating groove 103 is configured to accommodate the cards 100. Each of the step portions 403 loads one card. A user may store the cards 100 in the accommodating groove 103. When the cards 100 needs to be taken out, the user is able to push the sliding piece 2, so that the sliding piece 2 moves towards the opening 106 of the accommodating groove 103. Then the sliding piece 2 pushes the card pushing piece 4 to rotate towards the direction of the opening 106 of the accommodating groove 103, and the step portions 403 push the cards 100 accommodated in the accommodating groove 103 along with rotation of the card pushing piece 4. Therefore, the cards 100 are partially pushed out of the accommodating groove 103. Since the step portions 403 are arranged in steps; the cards being pushed out are also arranged in steps. Thus, the user is able to quickly distinguish the cards 100 and quickly extract a specific card 100 needed to be used. After the user releases the sliding piece 2, the card pushing piece 4 moves in the direction away from the opening 106 of the accommodating groove 103, so as to drive the sliding piece 2 to move in the direction away from the opening 106 of the accommodating groove 103 to complete resetting of the sliding piece 2. Therefore, after the user releases the sliding piece 2, the sliding piece 2 automatically reset, and the user does not need to manually push the sliding piece 2 back to an original position, which is convenient to use.

In the embodiment, the housing 1 is integrally formed. The housing 1 may be made of a metal material, such as aluminum alloy, iron, Tung, stainless steel, etc. In one optional embodiment, the housing 1 is made of the aluminum alloy and thus having characteristics of light weight, firmness and electromagnetic shielding. Therefore, the housing 1 is not only convenient to carry but also protects the cards 100 accommodated therein, thereby preventing the cards 100 from being demagnetized. Of course, in other embodiments, the housing 1 may also be made of other materials, such as plastic, ceramic, resin, etc., which is not limited therein. The sliding piece 2 may be a plate-shaped structure. Therefore, a holding feeling of the card storage device of the present disclosure is good.

Figure 4:
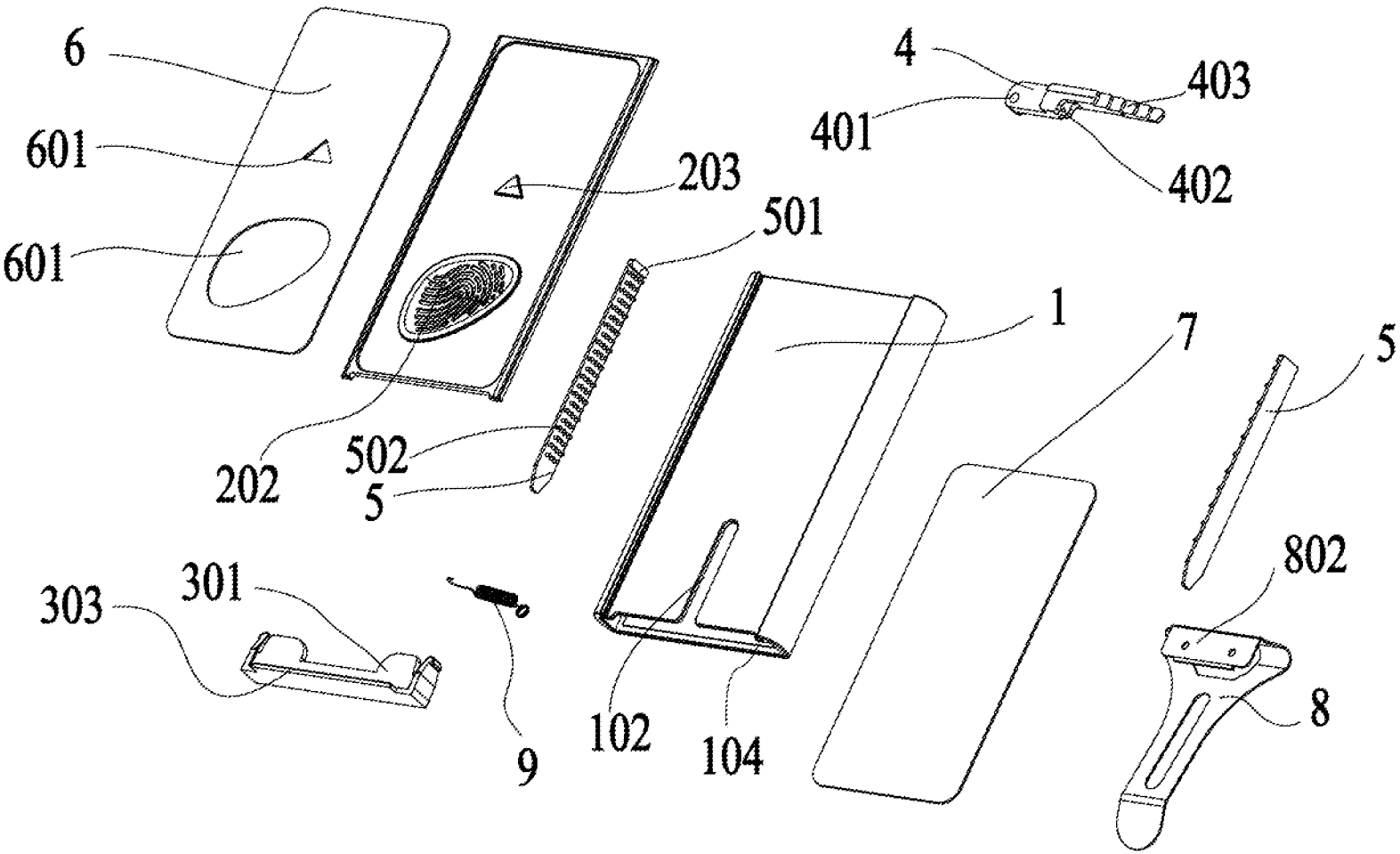
FIG. 4 is another exploded schematic diagram of the card storage device according to one embodiment of the present disclosure.
Figure 5:
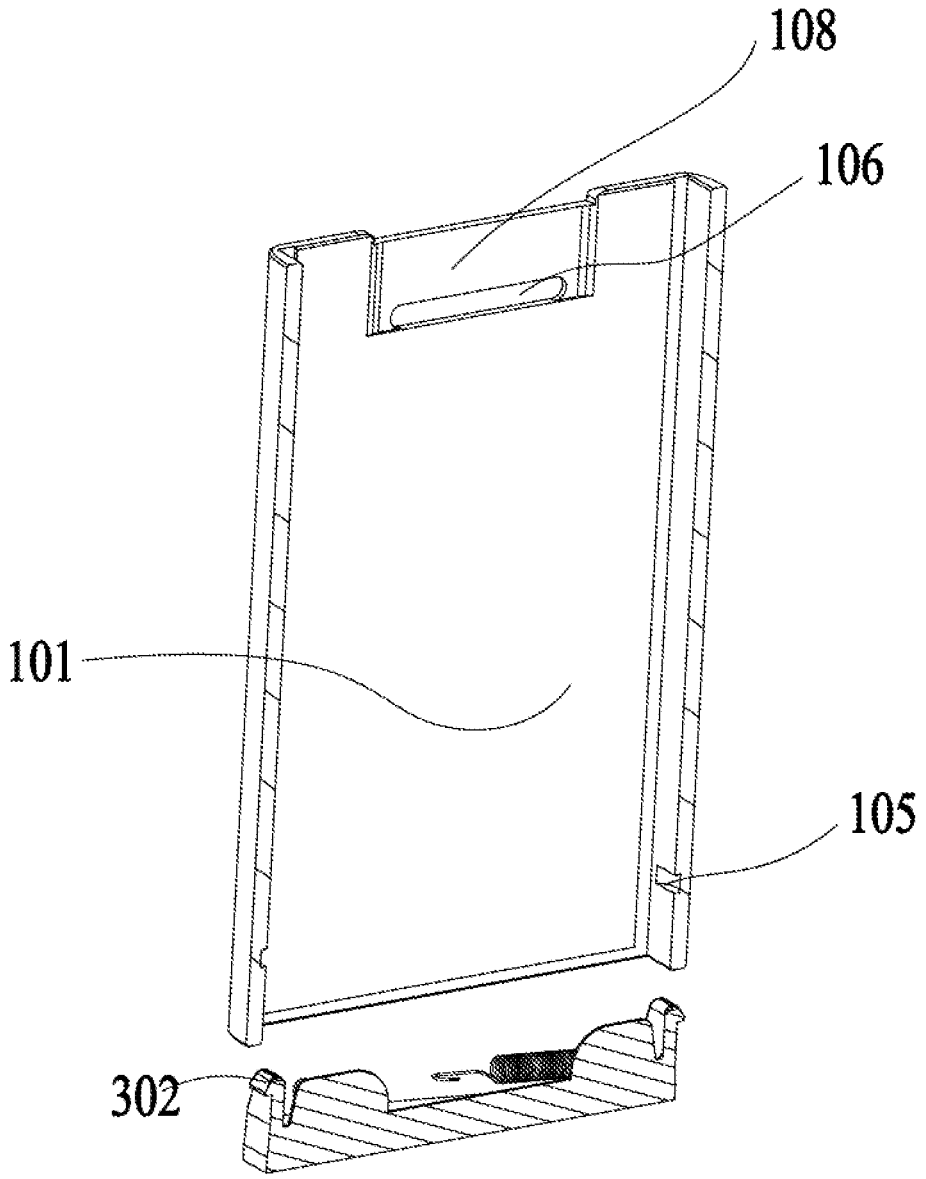
FIG. 5 is a perspective cross-sectional schematic diagram of a base and a housing of the card storage device according to one embodiment of the present disclosure.

In some embodiments, as shown in FIGS. 1 and 4, a limiting notch 102 is defined on a first side of the housing 1. A sliding structure 201 is arranged on a first side of the sliding piece 2. The sliding structure 201 is slidable in the limiting notch 102. The sliding structure 201 abuts against a bottom wall of the card pushing piece 4.

The card storage device further comprises a base 3. The base 3 is connected to the housing 1 and seals one end of the housing 1. The base 3 is rotatably connected to the card pushing piece 4. The base 3 seals an open end of the limiting notch 102. When the sliding piece 2 moves in a direction away from the base 3, the sliding structure 201 pushes the card pushing piece to rotate in the direction away from the base 3. When the card pushing piece 4 rotates in a direction close to the base 3, the card pushing piece 4 pushes the sliding structure 201 to move in the direction close to the base 3, so that the sliding piece 2 moves in the direction close to the base 3.

In the embodiment, the sliding structure 201 is a sliding column or a sliding block. The sliding structure 201 is clamped in the limiting notch 102, so that the sliding piece 2 does not shake left and right during a sliding process. When the cards 100 are accommodated in the accommodating groove 103, the card pushing piece 4 abuts against the cards 100, and each of the step portions loads one card 100.

When the cards 100 need to be taken out, the user is able to push the sliding piece 2, so that the sliding piece 2 moves in the direction away from the base 3. Since the sliding structure 201 is slidable in the limiting notch 102, the card pushing piece 4 is rotatably connected to the base 3, and the sliding structure 201 abuts against the bottom wall of the card pushing piece 4, so that the sliding structure 201 pushes the card pushing piece 4 to rotate in the direction away from the base 3. The step portions 403 push the cards 100 loaded by the step portions 403 along with the rotation of the card pushing piece 4. Therefore, the cards 100 are partially pushed out of the card storage device. Since the step portions 403 are arranged in steps, the cards 100 are also arranged in steps. Therefore, the user is able to quickly distinguish the cards 100 and quickly extract the specific card 100 that needs to be used. After the user releases the sliding piece 2, the card pushing piece 4 rotates in the direction close to the base 3. Since the sliding structure 201 abuts against the bottom wall of the card pushing piece 4, the card pushing piece 4 pushes the sliding structure 201 to move in the direction close to the base 3, so that the sliding piece 2 automatically moves in the direction close to the base 3 to complete the resetting of the sliding piece 2. Therefore, the user does not need to push the sliding piece 2 downwards with hands, and the sliding piece 2 is automatically reset under pushing of the card pushing piece 4, which is very convenient to use.

In some embodiments, a shaft hole 401 and a limiting hole 402 are defined on the card pushing piece 4. A rotating shaft 304 and a fixing shaft 305 are arranged on the base 3. The card storage device further comprises an elastic piece 9. The shaft hole 401 is defined on one end of the card pushing piece 4 away from the step portions 403. The rotating shaft 304 is inserted into the shaft hole 401, so that the card pushing piece 4 rotates around the rotating shaft 304. A first end of the elastic piece 9 is connected to the fixing shaft 305. A second end of the elastic piece 9 is connected to the limiting hole 402. When the sliding piece 2 moves in the direction away from the base 3, the sliding structure 201 pushes the card pushing piece 4 to rotate in the direction away from the base 3 and the elastic piece 9 extends. When the elastic piece 9 is reset, the elastic piece 9 pulls the card pushing piece 4 to rotate in the direction close to the base 3, and the card pushing piece 4 pushes the sliding structure 201 to move in the direction close to the base 3, so that the sliding piece 2 is reset.

In the embodiment, the card pushing piece 4 is rotatably connected to the base 3 through the shaft hole 401 and the elastic piece 9. The elastic piece 9 has a certain deformation capability. When the user pushes the sliding piece 2 to slide in the direction away from the base 3, the sliding structure 201 pushes the card pushing piece 4 to rotate, and the elastic piece 9 extends. When the user releases the sliding piece 2, the elastic piece 9 resets under action of an elastic force, and the elastic piece 9 pulls the card pushing piece 4 to rotate toward the base 3. The bottom wall of the card pushing piece 4 pushes the sliding structure 201 to move toward the base 3, thereby driving the sliding piece 2 to slide toward the base 3. Therefore, the user does not need to manually pull the sliding piece 2 to the base 3, and the sliding piece 2 automatically resets under the elastic force of the elastic piece 9, which is very convenient to use.

In the embodiments, the elastic piece 9 is one of a spring, an elastic strap, and an elastic sheet. When the elastic piece 9 is the spring, a first end of the spring is a collar, and the collar is sleeved on the fixing shaft 305. A second end of the spring is a hook. The hook hooks the limiting hole 402. When the elastic piece 9 is the elastic strap, the elastic strap is ring-shaped. A first end of the elastic strap is wound on the fixing shaft 305, and a second end of the elastic strap passes through the limiting hole 402. Alternatively, the elastic strap may also be a straight strap, and two ends of the elastic strap are respectively fixed on the fixing shaft 305 and the limiting hole 402 by knotting. When the elastic piece 9 is the elastic sheet, the elastic sheet is a Z-shaped elastic sheet. Of course, in other embodiments, the elastic piece 9 may be other structure, as long as corresponding functions of the elastic piece can be realized, which is not limited therein.

In some embodiments, the step portions 403 are arranged on a first side of the card pushing piece 4. A height difference between any two adjacent step portions 403 is a fixed value. The accommodating cavity 101 comprises a first cavity wall and a second cavity wall. The first cavity wall and the second cavity wall of the accommodating cavity 101 are arranged opposite to each other. A top wall of a step portion 403, closest to the shaft hole 401, of the step portions 403, is attached to the first cavity wall of the accommodating cavity 101. A bottom wall of a step portion 403, farthest away from the shaft hole 401, of the step portions, is attached to the second cavity wall of the accommodating cavity 101.

The card pushing piece 4 and the accommodating cavity 101 are enclosed to form the accommodating groove 103. When the cards 100 are accommodated in the accommodating groove 103, the card pushing piece 4 abuts against the cards 100. A size of the accommodating groove 103 changes with the rotation of the card pushing piece 4. However, since the top wall of the step portion 403 arranged on the first side of the card pushing piece and closest to the shaft hole 401 and the bottom wall of the step portion 403 furthest from the shaft hole 401 are respectively attached to the first cavity wall and the second cavity wall of the accommodating cavity 101, a thickness of the accommodating cavity 101 is always equal to a thickness of the accommodating groove 103. Therefore, the cards 100 are partially pushed out of the accommodating groove 103 along with the rotation of the card pushing piece 4. Moreover, by such arrangements, no matter where the cards 100 are in the accommodating groove, the cards 100 always contact corresponding step portions 403 and are pushed by the corresponding step portions 403.

Figure 3:
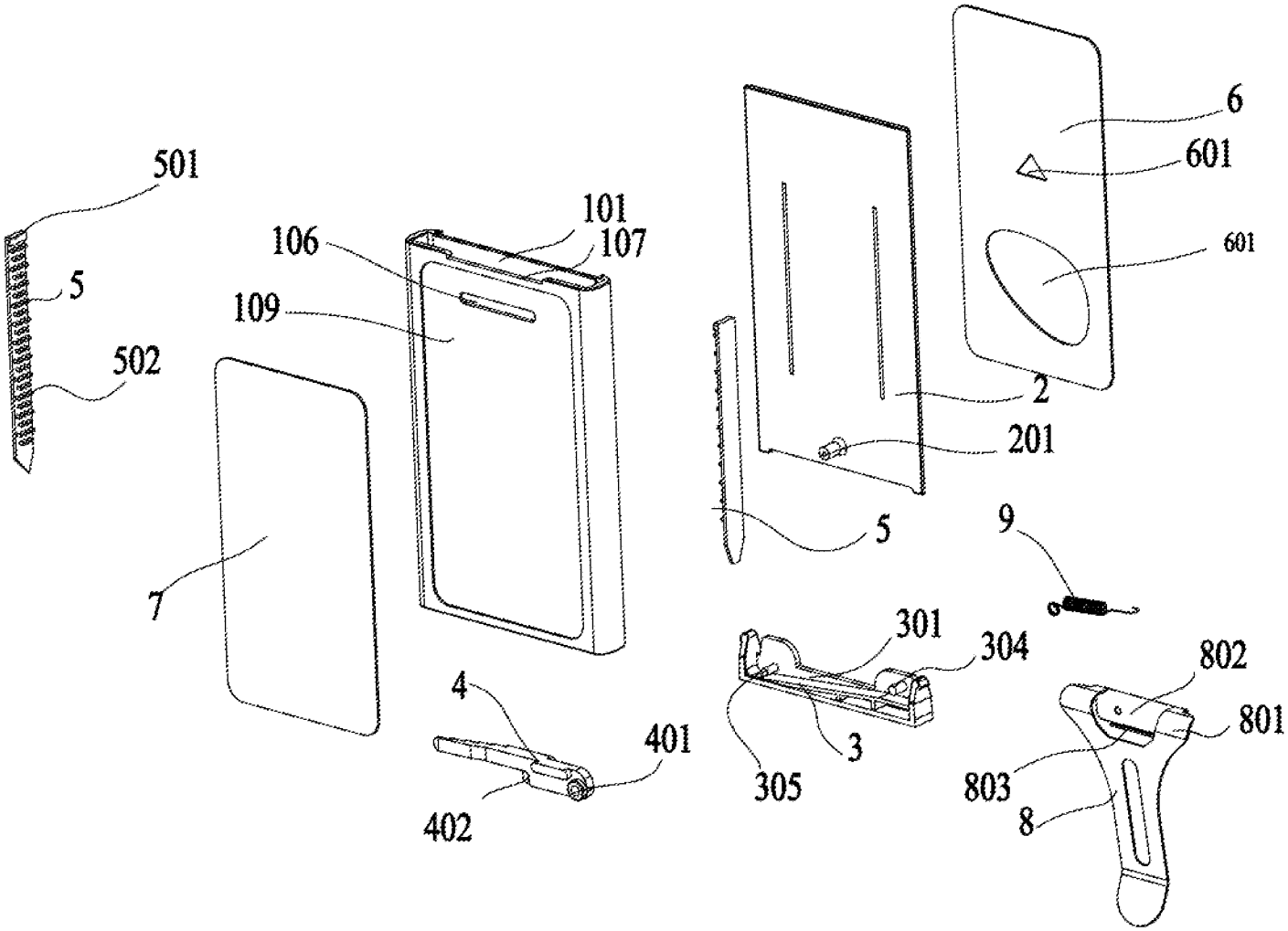
FIG. 3 is an exploded schematic diagram of the card storage device according to one embodiment of the present disclosure.
Figure 6:
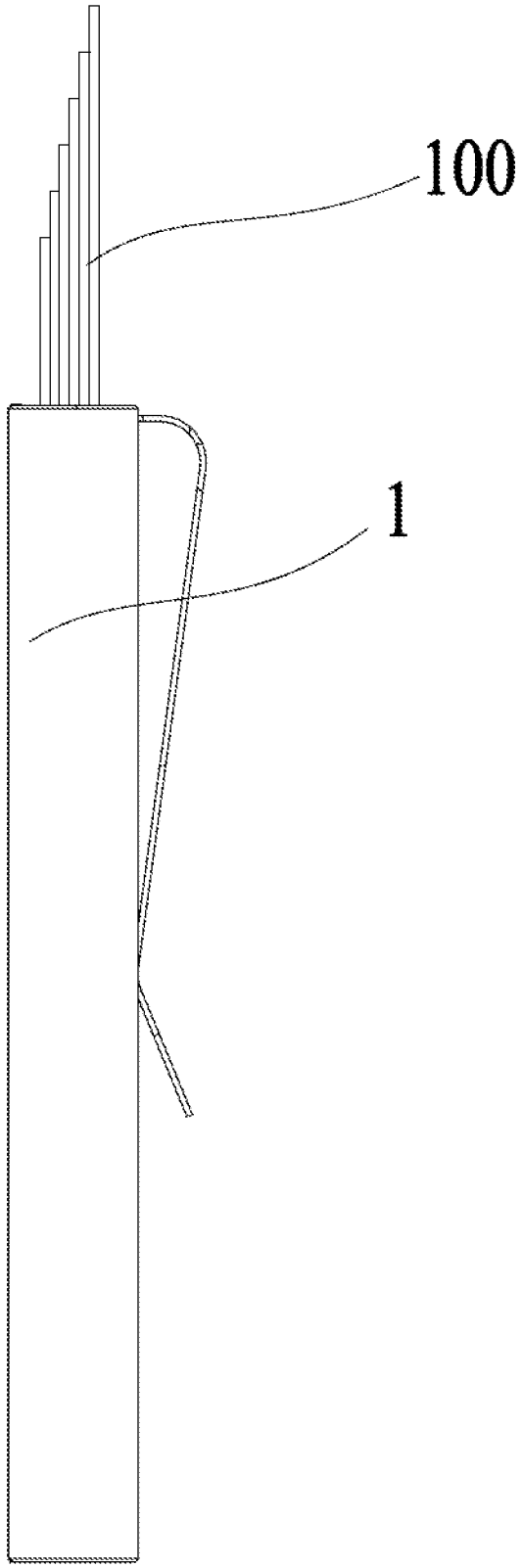
FIG. 6 is a side schematic diagram of the card storage device according to one embodiment of the present disclosure where cards are partially pushed out of an accommodating groove.

In the embodiment, the step portions 403 are only arranged on the first side of the card pushing piece 4. A height difference between two adjacent step portions 403 is equal to a thickness of each of the cards 100. It should be understood that the height difference between each two adjacent step portions 403 enables each of the step portions to accommodate one card 100. Of course, the height difference between each two adjacent step portions 403 may be slightly greater than the thickness of each of the cards 100. The number of the cards 100 accommodated in the accommodating groove 103 is determined by the number of the step portions 403. A horizontal distance between each two adjacent step portions 403 is equal to a height difference between each two adjacent cards 100 after the cards 100 are partially pushed out. That is, the greater the number of the step portions 403, the thicker the card storage device, and the smaller the height difference between each two adjacent cards 100 after the cards 100 are partially pushed out of the accommodating groove 103. Of course, the number of the step portions 403 is not as great as possible In order to facilitate the user to distinguish different cards 100, and in order to facilitate the user to separately extract the specific card 100 therein, the number and spacing of the step portions 403 need to be reasonably arranged. In the embodiment, as shown in FIGS. 3, 4, and 6, six step portions 403 are arranged. Namely, the card storage device of the present disclosure is able to accommodate six cards 100. When all the cards 100 are partially pushed out, the cards 100 are distributed in steps from high to low. In other embodiments, the number of the step portions 403 may be set to be other values, as long as the user is able to distinguish different cards 100, which is not limited therein. Furthermore, it should also be noted that when the accommodating groove is not full of the cards 100, a height of each of the cards being partially pushed out depends on a position of a corresponding step portion 403 abutting against each of the cards 100.

In some embodiments, the base 3 comprises a connecting portion 301 and two hook portion 302*s*. The two hook portion 302*s* are connected to the connecting portion 301. The two hook portion 302*s* are respectively arranged on two opposite sides of the connecting portion 301. The accommodating cavity 101 comprises two first grooves 105. The first grooves 105 are defined on two opposite sidewalls of the accommodating cavity 101. When the base 3 is connected to the housing 1, the one end of the housing 1 abuts against the connecting portion 301, and the two hook portion 302*s* respectively hook the two first grooves 105. Therefore, the base 3 is fixedly connected to the housing 1. In the embodiment, the base 3 is integrally formed, which saves production cost and also makes a structure of the base 3 stable.

In some embodiments, the base 3 further comprises a limiting block 303. The limiting block 303 is arranged on the connecting portion 301. The limiting block 303 seals the open end of the limiting notch 102 to limit a displacement of the sliding structure 201 and prevent the sliding piece 2 from sliding out of the housing 1. Sliding grooves 104 are defined on two ends of a first side of the housing 1. The sliding piece 2 is slidable along the sliding grooves 104.

The sliding grooves 104 limit a sliding space of the sliding piece 2. The sliding piece 2 only slides up and down along the sliding grooves 104. The limiting notch 102 and the limiting block 303 cooperate with each other to limit a sliding distance of the sliding structure 201, thereby limiting a sliding distance of the sliding piece 2. In the embodiment, in order to make the shape of the card storage device smooth and make the holding feeling good, two ends of the sliding piece 2 are flush with two ends of the housing 1. In other embodiments, a length of the sliding piece 2 is appropriately shortened as long as the sliding structure 201 is allowed to slide in the limiting notch 102. For example, the length of the sliding piece 2 is half of the housing 1 for illustration. When not in use, an upper half portion of the first side of the housing 1 is exposed, and the upper half portion of the first side of the housing 1 is configured as a functional area of the card storage device. For example, the upper half portion of the first side of the housing 1 is polished to form a reflective surface, so that the upper half portion of the first side of the housing 1 is configured as a cosmetic mirror for use. Of course, it is also possible to directly paste stickers on the upper portion of the first side of the housing 1, make inkjet, etc., on the upper portion of the first side of the housing 1, so that an appearance of the card storage device is rich and interesting.

In some embodiments, elastic friction bars 5 are arranged on two opposite sidewalls of the accommodating cavity 101. When the cards 100 are accommodated in the accommodating groove 103, the elastic friction bars 5 abuts against the cards 100. Specifically, each of the elastic friction bars 5 is integrally formed and is made of silicone, rubber, or other elastic material. When the cards 100 are accommodated in the accommodating groove 103, the elastic friction bars 5 and the cards 100 form an interference fit, preventing the cards 100 from shaking in the accommodating groove 103 and preventing the cards from slipping out of the accommodating groove 103. During a pushing process of the cards 100, the elastic friction bars 5 are configured to slow down a push-out speed of the cards 100 and limit push-out positions of the cards 100. Further, since the elastic friction bars 5 are made of elastic material, the cards 100 are not scratched by the elastic friction bars 5 during the pushing process of the cards 100.

Furthermore, friction columns 502 arranged in an array are arranged on each of the elastic friction bars 5. A limiting portion 501 is arranged on a top portion of each of the elastic friction bars 5.

When the cards 100 are stored in the accommodating groove 103, the friction columns 502 prevent the cards 100 from shaking in the accommodating groove 103, and each limiting portion 501 prevents the cards 100 from sliding out of the accommodating groove 103. When the card pushing piece 4 pushes the cards 100 upwards, the friction columns 502 slow down the push-out speed of the cards 100. When the cards 100 contact the limiting portion 501, under a pushing force of the card pushing piece 4, the cards 100 push away each limiting portion 501 and continues to move upward. When the cards 100 are pushed to predetermined positions, since two limiting portions 501 form the interference fit with the cards 100, the two limiting portions 501 abut against the cards 100. Thus, the cards 100 are limited at the predetermined positions. At this time, the user is able to quickly distinguish the cards 100 and extract the specific card 100 needed to be used. After use, the user is able to directly press the cards 100 into the accommodating groove 103.

In some embodiments, an anti-slip pattern 202 and an indicating arrow 203 are defined on a second side of the sliding piece 2. The indicating arrow 203 is configured to indicate a sliding direction of the sliding piece 2. The sliding piece 2 is pushed through the anti-slip pattern 202.

If the sliding piece 2 is too smooth, fingers of the user are easily slipped when pushing the sliding piece 2. Thus, the anti-slip pattern 202 is arranged on the sliding piece 2, which increases the friction between the fingers and the sliding piece 2, so the sliding piece 2 is pushed smoothly. The anti-slip pattern 202 is of a shape similar to a fingerprint, which is convenient for the user to understand use intention of the anti-slip pattern 202, so the user naturally places his fingers on an area of the anti-slip pattern 202 to push the sliding piece 2. Of course, the anti-slip pattern 202 can also be designed in different shapes, such as circular, elliptical, or other irregular pattern, etc., which is not limited thereto. Furthermore, it is understood that the anti-slip pattern 202 may be convex or concave with respect to a surface of the sliding piece 2, only if the anti-slip pattern is able to increase the friction between the fingers and the sliding piece, which is not limited thereto.

In some embodiments, the card storage device further comprises a first decorative sheet 6. A shape of the first decorative sheet 6 is matched with a shape of the sliding piece 2. The first decorative sheet 6 is attached to the sliding piece 2. Through holes 601 are defined on the first decorative sheet 6. Positions of the through holes 601 are respectively corresponding to a position of the anti-slip pattern 202 and a position of the indicating arrow 203. The anti-slip pattern 202 and the indicating arrow 203 are exposed from the through holes 601.

The first decorative sheet 6 may be made of stainless steel. For example, the first decorative sheet 6 is a stainless steel plate having a reflective surface formed by polishing. At this time, the first decorative sheet 6 is configured as a cosmetic mirror. The first decorative sheet 6 may also be made of a magnetic material, so that the card storage device is adsorbed on an object such as a refrigerator and a storage rack via the first decorative sheet 6, thereby facilitating storage of the card storage device. Alternatively, the first decorative sheet 6 may be made of a non-woven fabric or a flannelette, so that the card storage device has a good hand feeling and the user does not feel cold when touching the card storage device in winter. The first decorative sheet 6 may also be a sticker with a pattern, and is directly attached to the sliding piece 2, so that the card storage device has a beautiful appearance. The first decorative sheet 6 may be made of different materials, the above description is only a part of the examples, which is not limited therein. In the embodiment, a connecting method of the first decorative sheet 6 is also different according to different materials thereof. Specifically, the first decorative sheet 6 may be fixed on the sliding piece 2 by welding or glue, or may be detachably connected to the sliding piece 2 by fasteners such as screws and magnets, and the specific connecting method is determined by the material of the first decorative sheet 6.

In some embodiments, a second side of the housing 1 is recessed to form a second groove 109. The card storage device further comprises a second decorative sheet 7. The second decorative sheet 7 is embedded in the second groove 109. The second decorative sheet 7 can also be made of different materials. For details, reference may be made to the above description of the first decorative sheet 6. The material of the second decorative sheet 7 may be the same as or different from the material of the first decorative sheet 6, and different solutions may be selected according to different application scenarios, which is not limited thereto.

Furthermore, the card storage device further comprises a snapping clip 8. The snapping clip 8 is detachably connected to the housing 1. Specifically, a clipping notch 107 is defined on the second side of the housing 1. A snapping hole 106 is defined on a bottom wall of the second groove 109. A concave portion 108 is defined on the accommodating groove 103. The snapping hole 106 is defined on the concave portion 108. The snapping clip 8 comprises a clipping portion 801, an attaching portion 802, and a snapping portion 803. The attaching portion 802 connects the clipping portion 801 with the snapping portion 803. The clipping portion 801 is clamped in the chipping notch 107. Since the clipping notch 107 is lower than an outer edge of the housing 1, when the clipping portion 801 is clamped in clipping notch 107, a height of the snapping clip 8 does not exceed the housing 1, and the snapping clip 8 has the god holding felling and has a beautiful appearance. The attaching portion 802 is inserted into the accommodating groove 103 and attached to the concave portion 108. The attaching portion 802 is flush with a sidewall of the accommodating groove 103. Therefore, when the snapping clip 8 is connected to the housing 1, the snapping clip 8 does not scratch the cards 100 accommodated in the accommodating groove 103. The snapping portion 803 is snapped on the snapping hole 106. An outer sidewall of the snapping portion 803 is flush with the bottom wall of the second groove 109. Therefore, the second decorative sheet 7 is embedded in the second groove 109. Through the snapping clip 8, the card storage device is able to be fastened on clothes of the user, such as on clipped on a waist of trousers, shirt pocket, etc., so as to facilitate carrying of the card storage device. When the snapping clip is not used, the snapping clip is directly detached from the housing 1, thereby reducing the storage space of the card storage device.

Embodiment 2

Figure 7:
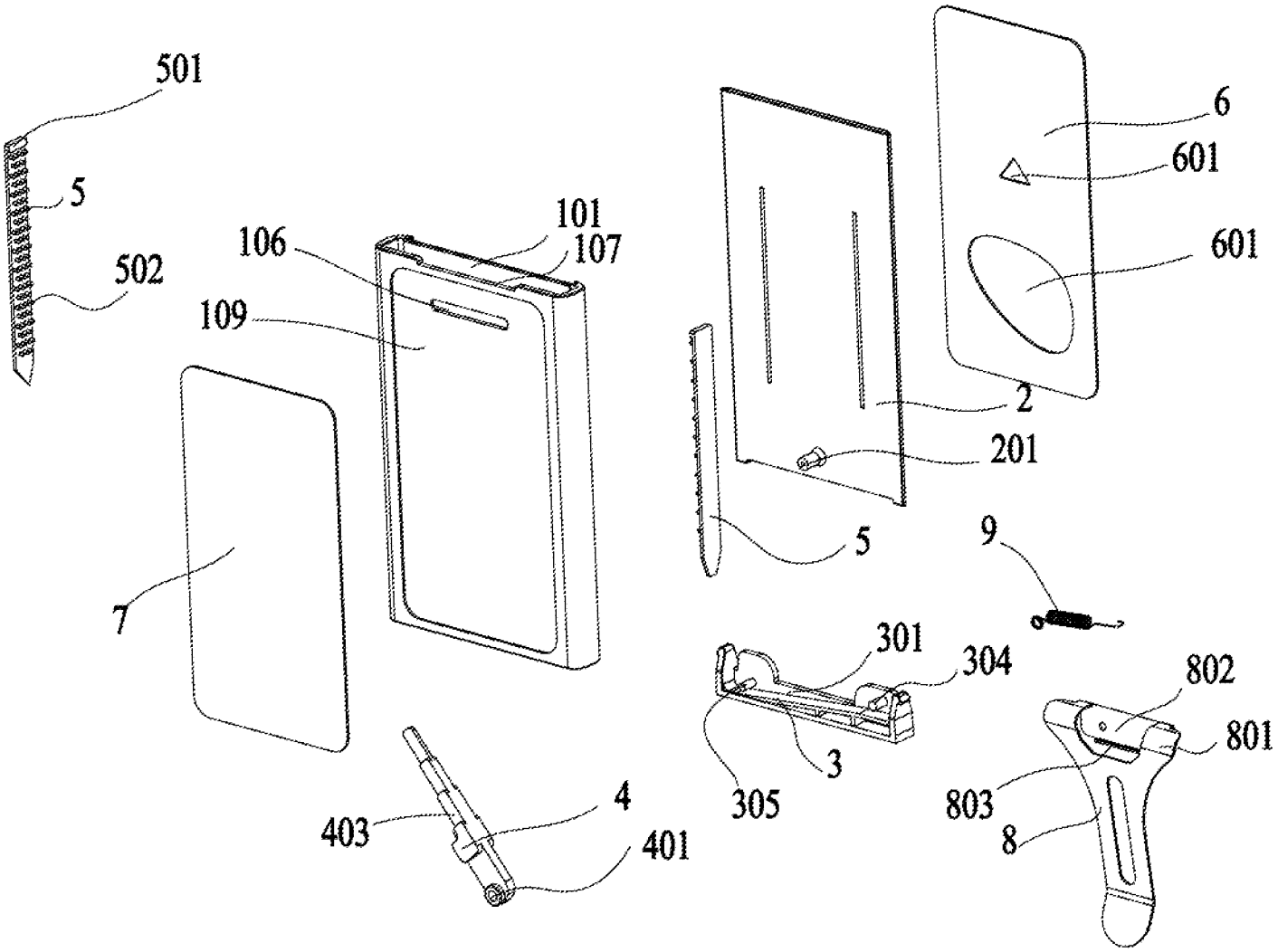
FIG. 7 is an exploded schematic diagram of the card storage device according to another embodiment of the present disclosure.
Figure 8:
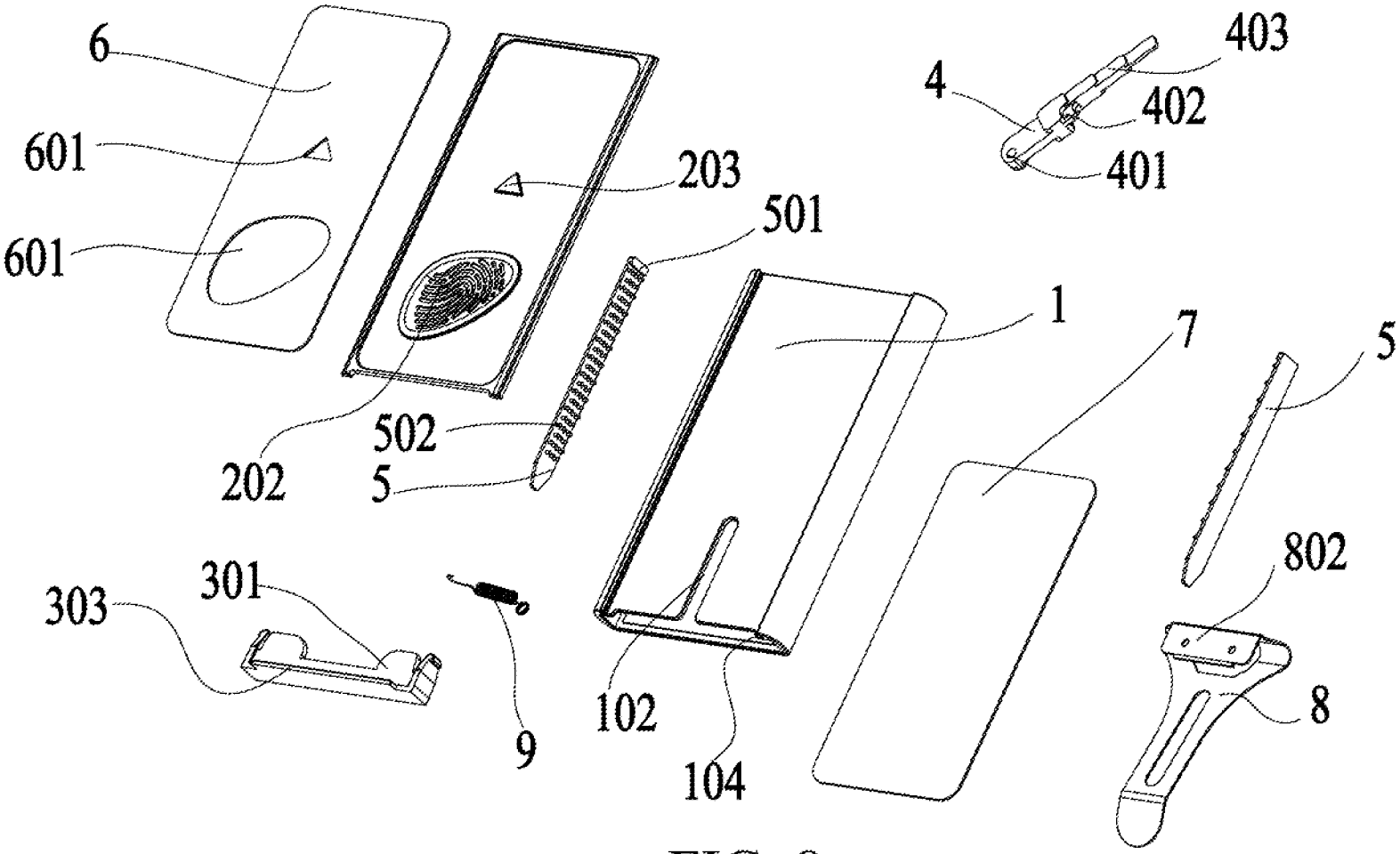
FIG. 8 is another exploded schematic diagram of the card storage device according to another embodiment of the present disclosure.
Figure 9:
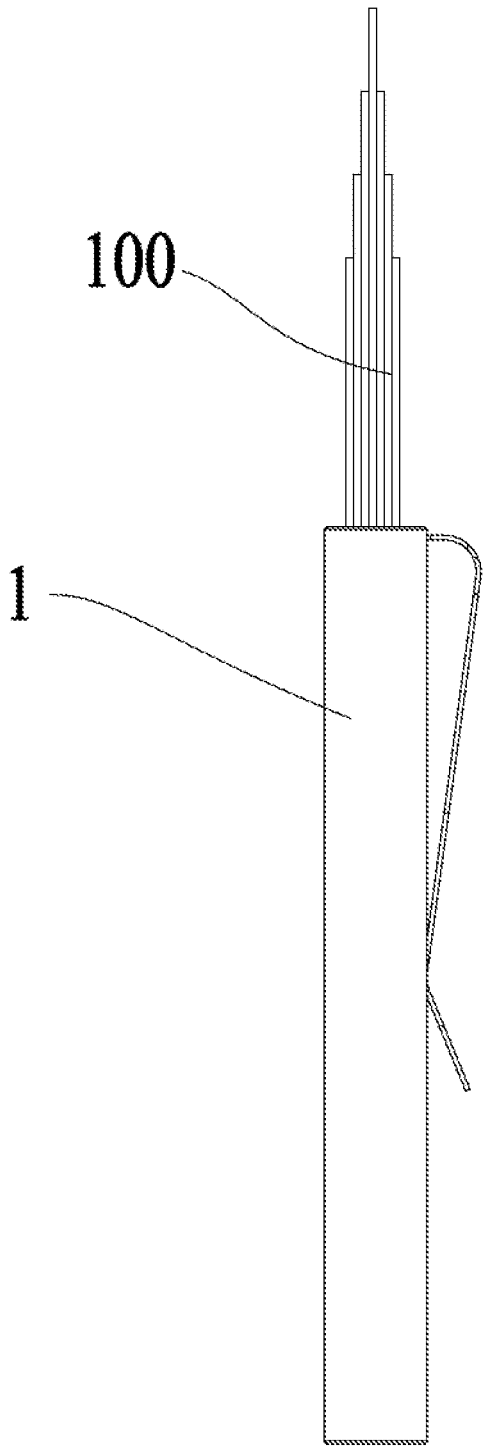
FIG. 9 is a side schematic diagram of the card storage device according to another embodiment of the present disclosure where the cards are partially pushed out of the accommodating groove.

In the embodiment, as shown in FIGS. 7-9, the card pushing piece 4 of the embodiment is different from the card pushing piece 4 of the embodiment 1, while other structures of the card storage devices are the same. Specifically, the step portions are arranged on the first side and a second side of the card pushing piece 4. A height difference between any two adjacent step portions 403 arranged on a same side is a fixed value.

In some embodiments, the accommodating cavity 101 comprises the first cavity wall and the second cavity wall. The first cavity wall and the second cavity wall of the accommodating cavity 101 are arranged opposite to each other. A step portion 403, arranged on the first side of the card pushing piece 4 and closest to the shaft hole 401, of the step portions, is attached to the first cavity wall of the accommodating cavity 101. A step portion 403, arranged on the second side of the card pushing piece 4 and closest to the shaft hole 401, of the step portions, is attached to the second cavity wall of the accommodating cavity 101.

Specifically, the card pushing piece 4 and the accommodating cavity 101 are enclosed to form the accommodating groove 103. When the cards 100 are accommodated in the accommodating groove 103, the card pushing piece 4 abuts against the cards 100. The size of the accommodating groove 103 changes with the rotation of the card pushing piece 4. However, since the step portion 403, arranged on the first side of the card pushing piece 4 and closest to the shaft hole 401, of the step portions, is attached to the first cavity wall of the accommodating cavity 101, and since the step portion 403, arranged on the second side of the card pushing piece 4 and closest to the shaft hole 401, of the step portions, is attached to the second cavity wall of the accommodating cavity 101, the thickness of the accommodating cavity 101 is always equal to the thickness of the accommodating groove 103. Therefore, the cards 100 are partially pushed out of the accommodating groove 103 along with the rotation of the card pushing piece 4. Moreover, by such arrangements, no matter where the cards 100 are in the accommodating groove, the cards 100 always contact the corresponding step portions 403 and are pushed by the corresponding step portions 403.

In the embodiment, the height difference between two adjacent step portions 403 is equal to the thickness of each of the cards 100. The number of the cards 100 accommodated in the accommodating groove 103 is determined by the number of the step portions 403. An horizontal distance between each two adjacent step portions 403 arranged on the same side is equal to the height difference between each two adjacent cards 100 after the cards 100 are partially pushed out.

It is understood that the greater the number of the step portions 403, the thicker the card storage device, and the smaller the height difference between each two adjacent cards 100 after the cards 100 are partially pushed out of the accommodating groove 103. Of course, the number of the step portions 403 is not as great as possible In order to facilitate the user to distinguish different cards 100, and in order to facilitate the user to separately extract the specific card 100 therein, the number and spacing of the step portions 403 need to be reasonably arranged. In the embodiment, seven step portions 403 are provided. Namely, the card storage device of the present disclosure is able to accommodate seven cards 100. In other embodiments, the number of the step portions 403 may be set to be other values, as long as the user is able to distinguish different cards 100, which is not limited therein. Furthermore, it should also be noted that when the accommodating groove is not full of the cards 100, the height of each of the cards being partially pushed out depends on a position of a corresponding step portion 403 abutting against each of the cards 100.

Furthermore, the step portions 403 arranged on the first side of the card pushing piece 4 are symmetrically arranged with the step portions 403 arranged on the second side of the card pushing piece 4.

Since the step portions 403 arranged on two sides of the card pushing piece 4 are symmetrically arranged, when the card storage device is full of the cards 100, the cards 100 partially pushed out by the card pushing piece 4 are symmetrically arranged in a peak shape (as shown in FIG. 9). Moreover, since the step portions 403 are symmetrically arranged on two sides of the card pushing piece 4, the horizontal distance between two adjacent step portions on the same side is relatively large. In a case that the thickness of the accommodating groove of the embodiment is same as the thickness of the accommodating groove of the embodiment 2, the height difference between each two adjacent cards 100 is greater in the embodiment. That is, an exposed portion of each of the cards 100 is greater than that of the cards in the embodiment 1, so that the user is able to more easily distinguish the cards 100, and more easily extract the specific card 100.

Alternatively, the step portions 403 arranged on the first side of the card pushing piece 4 may be staggered with the step portions 403 arranged on the second side of the card pushing piece 4, only if the arrangement is reasonable, which is not limited therein.

The embodiments, implementations and related technical features of the present disclosure can be combined and replaced with each other without conflict.

It should be understood in the description of the present disclosure that terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified.

The above are only optional embodiments of the present disclosure and specifically depict technical principles of the present disclosure. These descriptions are only for explaining the principles of the present disclosure, and cannot be interpreted as limiting of the protection scope of the present disclosure in any way. Based on the explanations, any modification, equivalent replacement, and improvement made within the spirit and principle of the disclosure, and other specific implementations of the present disclosure obtained by those skilled in the art without creative work, should fall within the protection scope of the present disclosure.

What is claimed is:

1. A card storage device, comprising:

a housing defining an accommodating cavity, a sliding piece slidably connected to the housing, and a card pushing piece arranged in the housing;

wherein the accommodating cavity penetrates the housing; the card pushing piece is connected to the sliding piece; the card pushing piece and the accommodating cavity are enclosed to form an accommodating groove; step portions are arranged on at least one side of the card pushing piece; the step portions are arranged in steps;

wherein when the sliding piece moves toward an opening of the accommodating groove, the sliding piece drives the card pushing piece to move toward the opening of the accommodating groove; when the card pushing piece moves in a direction away from the opening of the accommodating groove, the card pushing piece drives the sliding piece to move in the direction away from the opening of the accommodating groove;

wherein elastic friction bars are arranged on two opposite sidewalls of the accommodating cavity; a limiting portion is arranged on a top portion of each of the elastic friction bars.

2. The card storage device according to claim 1, wherein a limiting notch is defined on a first side of the housing; a sliding structure is arranged on a first side of the sliding piece; the sliding structure is slidable in the limiting notch; the sliding structure abuts against a bottom wall of the card pushing piece.

3. The card storage device according to claim 2, wherein the card storage device further comprises a base, the base is connected to the housing and seals one end of the housing; the base seals an open end of the limiting notch;

wherein when the sliding piece moves in a direction away from the base, the sliding structure pushes the card pushing piece to rotate in the direction away from the base; when the card pushing piece rotates in a direction close to the base, the card pushing piece pushes the sliding structure to move in the direction close to the base, so that the sliding piece moves in the direction close to the base.

4. The card storage device according to claim 3, wherein a shaft hole and a limiting hole are defined on the card pushing piece; a rotating shaft and a fixing shaft are arranged on the base; the card storage device further comprises an elastic piece; the shaft hole is defined on one end of the card pushing piece away from the step portions; the rotating shaft is inserted into the shaft hole; the card pushing piece rotates around the rotating shaft; a first end of the elastic piece is connected to the fixing shaft; a second end of the elastic piece is connected to the limiting hole;

wherein when the sliding piece moves in the direction away from the base, the sliding structure pushes the card pushing piece to rotate in the direction away from the base and the elastic piece extends; when the elastic piece is reset, the elastic piece pulls the card pushing piece to rotate in the direction close to the base, and the card pushing piece pushes the sliding structure to move in the direction close to the base, so that the sliding piece is reset.

5. The card storage device according to claim 4, wherein the step portions are arranged on a first side of the card pushing piece; a height difference between any two adjacent step portions is a fixed value.

6. The card storage device according to claim 5, wherein the accommodating cavity comprises a first cavity wall and a second cavity wall; the first cavity wall and a second cavity wall of the accommodating cavity are arranged opposite to each other; a top wall of a step portion, closest to the shaft hole, of the step portions, is attached to the first cavity wall of the accommodating cavity; a bottom wall of a step portion, farthest away from the shaft hole, of the step portions, is attached to the second cavity wall of the accommodating cavity.

7. The card storage device according to claim 4, wherein the step portions are arranged on a first side and a second side of the card pushing piece; a height difference between any two adjacent step portions arranged on a same side is a fixed value.

8. The card storage device according to claim 7, wherein the step portions arranged on the first side of the card pushing piece are symmetrically arranged with the step portions arranged on the second side of the card pushing piece.

9. The card storage device according to claim 7, wherein the accommodating cavity comprises a first cavity wall and a second cavity wall; the first cavity wall and a second cavity wall of the accommodating cavity are arranged opposite to each other; a step portion, arranged on the first side of the card pushing piece and closest to the shaft hole, of the step portions, is attached to the first cavity wall of the accommodating cavity; a step portion, arranged on the second side of the card pushing piece and closest to the shaft hole, of the step portions, is attached to the second cavity wall of the accommodating cavity.

10. The card storage device according to claim 4, wherein the elastic piece is one of a spring, an elastic strap, and an elastic sheet.

11. The card storage device according to claim 2, wherein the base comprises a connecting portion and two hook portions; the two hook portions are connected to the connecting portion; the two hook portions are respectively arranged on two opposite sides of the connecting portion; the accommodating cavity comprises two first grooves; the first grooves are defined on two opposite sidewalls of the accommodating cavity; when the base is connected to the housing, the one end of the housing abuts against the connecting portion, and the two hook portions respectively hook the two first grooves.

12. The card storage device according to claim 11, wherein the base further comprises a limiting block; the limiting block is arranged on the connecting portion; the limiting block seals the open end of the limiting notch to limit a displacement of the sliding structure and prevent the sliding piece from sliding out of the housing.

13. The card storage device according to claim 1, wherein sliding grooves are defined on two ends of a first side of the housing; the sliding piece is slidable along the sliding grooves.

14. The card storage device according to claim 1, wherein friction columns arranged in an array are arranged on each of the elastic friction bars.

15. The card storage device according to claim 1, wherein an anti-slip pattern and an indicating arrow are defined on a second side of the sliding piece; the indicating arrow is configured to indicate a sliding direction of the sliding piece; the sliding piece is pushed through the anti-slip pattern.

16. The card storage device according to claim 15, wherein the card storage device further comprises a first decorative sheet; a shape of the first decorative sheet is matched with a shape of the sliding piece; the first decorative sheet is attached to the sliding piece; through holes are defined on the first decorative sheet; positions of the through holes are respectively corresponding to a position of the anti-slip pattern and a position of the indicating arrow; the anti-slip pattern and the indicating arrow are exposed from the through holes.

17. The card storage device according to claim 16 wherein the card storage device further comprises a second decorative sheet; a second side of the housing is recessed to form a second groove; the second decorative sheet is embedded in the second groove.

18. The card storage device according to claim 1, wherein a second side of the housing is recessed to form a second groove; a clipping notch is defined on the second side of the housing; a snapping hole is defined on a bottom wall of the second groove; a concave portion is defined on the accommodating groove; the snapping hole is defined on the concave portion; the card storage device further comprises a snapping clip; the snapping clip is detachably connected to the housing; the snapping clip comprises a clipping portion, an attaching portion, and a snapping portion; the attaching portion connects the clipping portion with the snapping portion; the clipping portion is clamped in the chipping notch; the attaching portion is inserted into the accommodating groove and attached to the concave portion; the attaching portion is flush with a sidewall of the accommodating groove; the snapping portion is snapped on the snapping hole; an outer sidewall of the snapping portion is flush with the bottom wall of the second groove.

19. A card storage device, comprising:

a housing defining an accommodating cavity, a sliding piece slidably connected to the housing, and a card pushing piece arranged in the housing;

wherein the accommodating cavity penetrates the housing; the card pushing piece is connected to the sliding piece; the card pushing piece and the accommodating cavity are enclosed to form an accommodating groove; step portions are arranged on at least one side of the card pushing piece; the step portions are arranged in steps;

wherein when the sliding piece moves toward an opening of the accommodating groove, the sliding piece drives the card pushing piece to move toward the opening of the accommodating groove; when the card pushing piece moves in a direction away from the opening of the accommodating groove, the card pushing piece drives the sliding piece to move in the direction away from the opening of the accommodating groove;

wherein an anti-slip pattern is defined on one side of the sliding piece; the sliding piece is pushed through the anti-slip pattern.

20. A card storage device, comprising:

a housing defining an accommodating cavity, a sliding piece slidably connected to the housing, and a card pushing piece arranged in the housing;

wherein the accommodating cavity penetrates the housing; the card pushing piece is connected to the sliding piece; the card pushing piece and the accommodating cavity are enclosed to form an accommodating groove; step portions are arranged on at least one side of the card pushing piece; the step portions are arranged in steps;

wherein when the sliding piece moves toward an opening of the accommodating groove, the sliding piece drives the card pushing piece to move toward the opening of the accommodating groove; when the card pushing piece moves in a direction away from the opening of the accommodating groove, the card pushing piece drives the sliding piece to move in the direction away from the opening of the accommodating groove;

wherein the housing defines a first side and a second side; the second side of the housing is recessed to form a groove.

* * * * *